US005582060A

United States Patent [19]

Schubert

[11] Patent Number: 5,582,060

[45] Date of Patent: Dec. 10, 1996

[54] FORGING MACHINE

[76] Inventor: Peter Schubert, Kristallweg 7, Kaarst, Germany, 41564

[21] Appl. No.: 358,010

[22] Filed: Dec. 16, 1994

[30] Foreign Application Priority Data

Dec. 16, 1993 [DE] Germany ..... 43 42 925.4

[51] Int. Cl.[6] ..... B21J 7/14; B21J 13/03

[52] U.S. Cl. ..... 72/402; 72/447; 72/482.7

[58] Field of Search ..... 72/402, 447, 446, 72/441, 482, 481.7, 482.7; 100/226

[56] References Cited

U.S. PATENT DOCUMENTS

| | | | |
|---|---|---|---|
| 2,245,806 | 6/1941 | Oeckl | 72/482 |
| 4,796,456 | 1/1989 | Schmoll et al. | 72/402 |
| 4,813,263 | 3/1989 | Schubert et al. | 72/402 |
| 4,831,864 | 5/1989 | Schmoll et al. | 72/402 |
| 5,293,769 | 3/1994 | Schubert | 72/402 |
| 5,313,816 | 5/1994 | Schubert et al. | 72/402 |

FOREIGN PATENT DOCUMENTS

| | | | |
|---|---|---|---|
| 549825 | 7/1993 | European Pat. Off. | 72/482 |
| 286996 | 9/1915 | Germany | 72/482 |

*Primary Examiner*—Daniel C. Crane

*Attorney, Agent, or Firm*—Jacobson, Price, Holman & Stern, PLLC

[57] ABSTRACT

A forging machine has four rams arranged at 90° to one another in a cruciform manner in one plane; these act radially upon the workpiece, guided longitudinally in the system axis, and are equipped with tools. In order that the tools may form a closed pass contour in different adjustable stroke-end positions they are connected to the rams by way of supports and are displaceable transversely to the ram axis, releasable clamping members being provided which each lock a support against a front face of a ram. The suction arising during separation of the supports from the front faces of the rams can lead to the penetration of dirt (scale) into the gaps between the front faces of the rams and the supports. The supports (17) are provided with locking teeth (40) on their sides parallel to the displacement plane, the teeth (40) extending transversely to the displacement direction, and locking members (42), locked on the rams (2) in the displacement direction, can be engaged and disengaged with the locking teeth. In particular, the locking members (42) are secured to the ram (2) so as to be pivotable about shafts (41) parallel to the displacement direction and are provided at their free ends, facing the supports (17), with teeth corresponding to the teeth (40) on the supports (17). This minimises the risk of suction due to separation of the support from the ram.

6 Claims, 4 Drawing Sheets

FORGING MACHINE

BACKGROUND OF THE INVENTION

In order to forge workpieces with a distinct longitudinal axis, forging machines are used which have three or more rams angularly distributed in one plane, and in particular four rams which are arranged offset at 90° to one another in a cruciform manner. The rams act radially upon a workpiece which is guided longitudinally on the system axis, and are equipped with tools, or dies. Because of the considerable forming capacity of these radial-forming forging machines, a high degree of enclosure, up to complete encirclement, of the workpiece has to be provided in the forming region. To this end, the tools should form a closed pass contour in any operative inner end position of the stroke. For this purpose the tools can be set and fixed in their common plane by means of tool supports on the rams by displacement devices, acting upon the tool supports, as a function of the setting of the inner end position of the stroke of the rams, in such a way that the part of their operating face exceeding the pass-contour dimension is covered by a lateral face of the adjacent tool as disclosed for example in U.S. Pat. Nos. 4,796,456, 4,813,263, 4,831,864, 5,293,769, 5,313,816, corresponding to EP 0 228 031 B1, EP 0 260 546 B1, EP 0 549 825 B1.

In the case of known forging machines the tool supports are connected to the rams by releasable clamping members each pressing a support against a front face of a ram, and the tools are connected to the supports, the clamping members being released in order to adjust the tools. Toothed racks are embedded in the front faces of the rams and the faces of the supports facing the said front faces, the toothed racks being provided with teeth orientated transversely to the tool displacement direction and producing positive locking by tooth engagement when the supports are resting against the front faces of the rams. In order to displace the supports transversely to the rams, the supports must be pushed so far away from the front faces of the rams that the teeth become disengaged. The resulting suction can lead to the penetration of dirt (scale) into the gaps between the front faces of the rams and the supports, and therefore to the fastening of the rams and the supports being adversely affected, unless this is counteracted by blowing out air as in U.S. Pat. Nos. 4,796,456, 4,813,263 (EP 0 228 030 B1).

The object of the invention is to improve the fastenings of the rams and the tool supports of such forging machines in such a way that they are better suited to the rough conditions of forging operations.

SUMMARY OF THE INVENTION

This object is attained according to the invention in that the tool supports are provided on their sides parallel to the tool displacement plane with teeth transverse to the tool displacement direction, into and out of which locking members, locked on the rams in the displacement direction, can be engaged and disengaged.

A structurally simple, robust and therefore particularly advantageous solution consists in that, according to a further feature of the invention, the locking members are secured to the ram so as to be pivotable about shafts parallel to the displacement direction and are provided at their free ends facing the supports with teeth corresponding to the teeth on the supports.

In particular, springs are provided in order to engage the locking members, the springs being counteracted by piston-cylinder units which can be acted upon for disengaging the locks.

BRIEF DESCRIPTION OF THE DRAWINGS

An embodiment of the invention is illustrated in the drawings, in which.

DESCRIPTION OF THE PREFERRED EMBODIMENT

Figure 1:
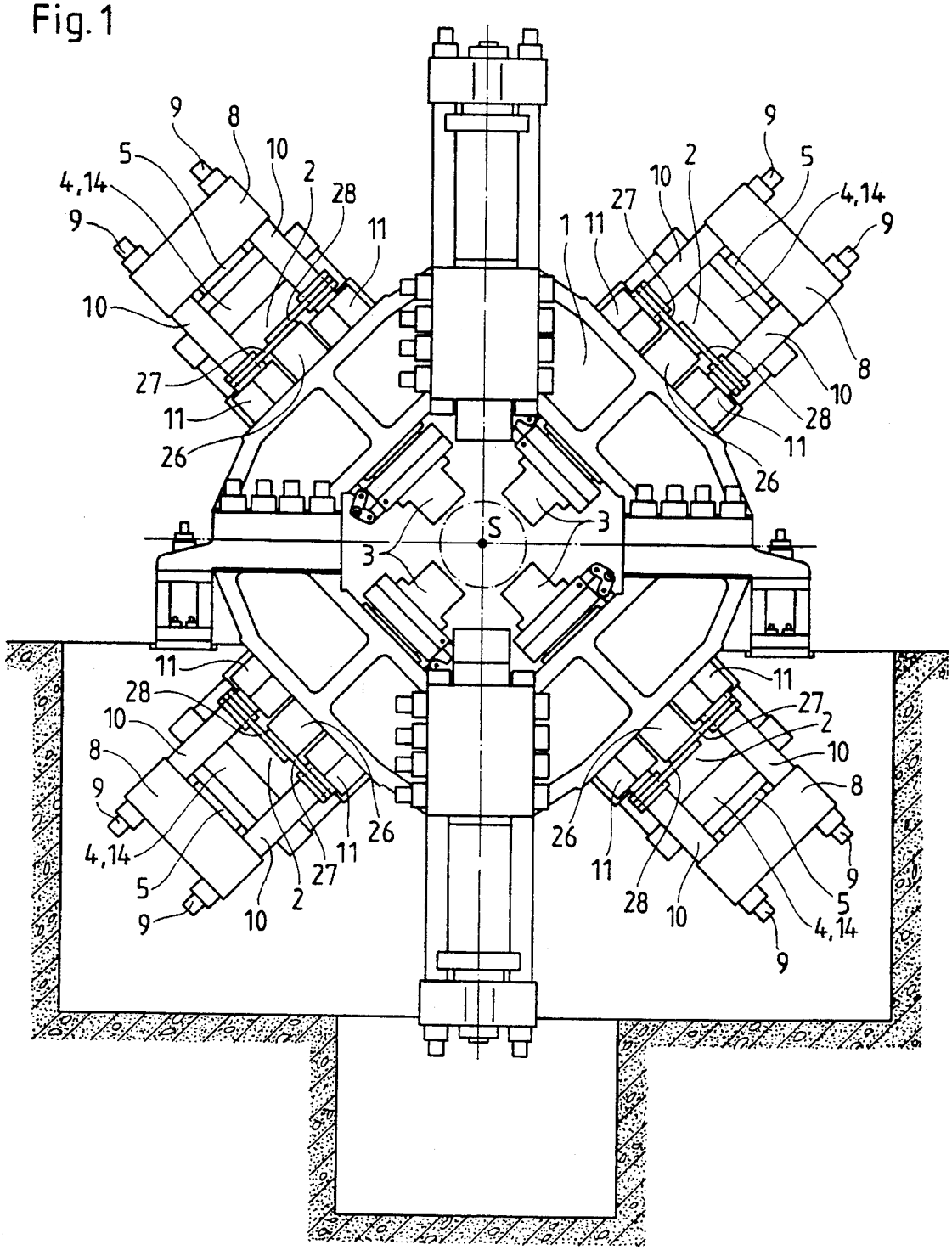
FIG. 1 is a front elevation of a forging machine viewed in the direction of the system axis S.
Figure 2:
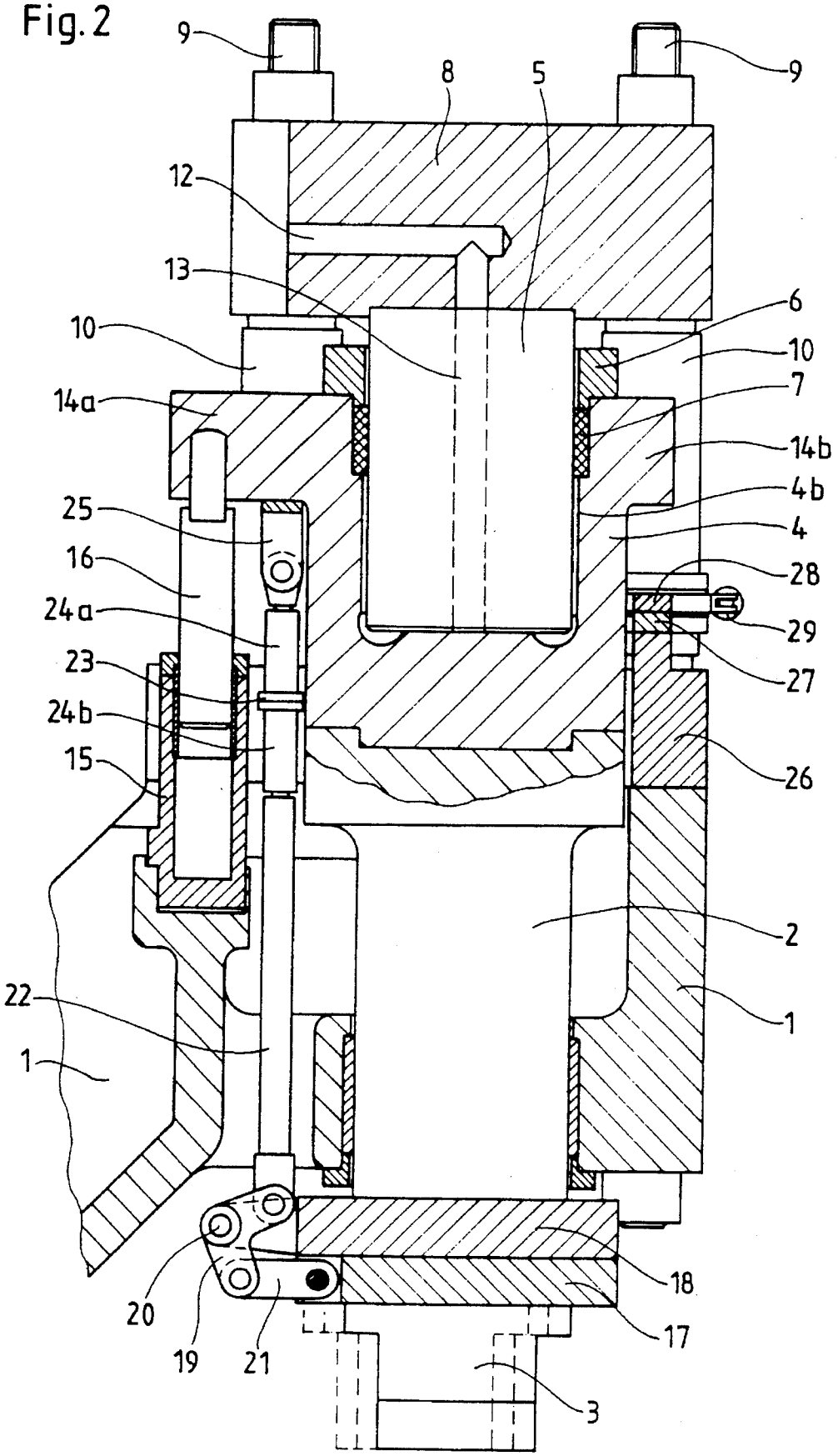
FIG. 2 is a detailed view on a larger scale, in section in the operating plane of the tools at right angles to the system axis S, and in a plane enclosing the system axis S in the upper right hand part of FIG. 2.
Figure 3:
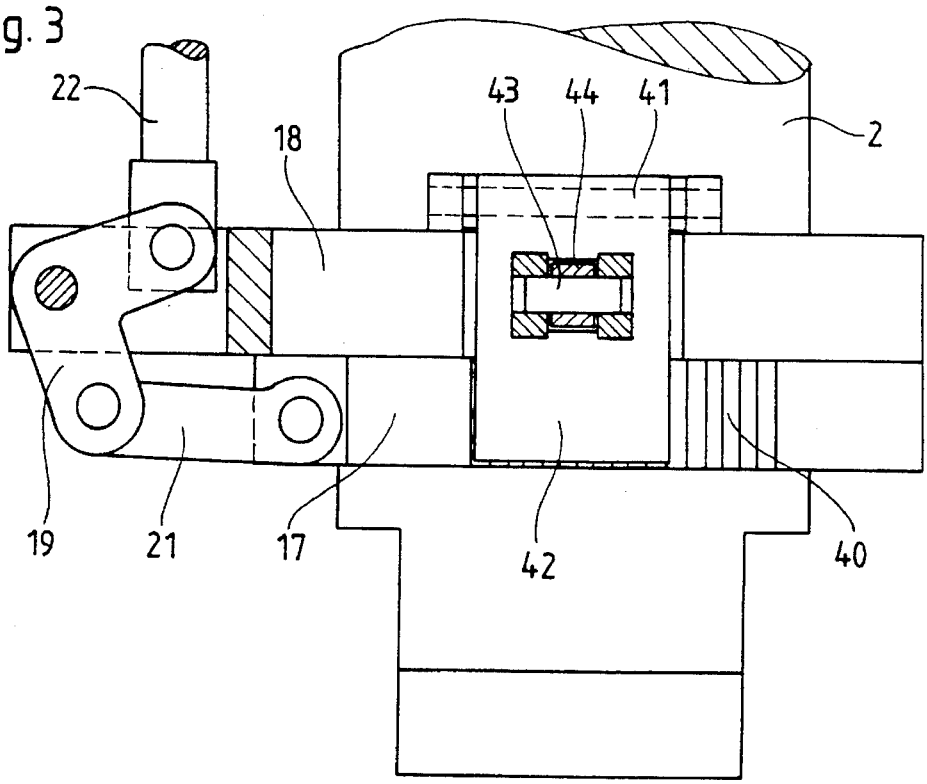
FIG. 3 is a detailed view, likewise on a larger scale, of the front elevation.
Figure 4:
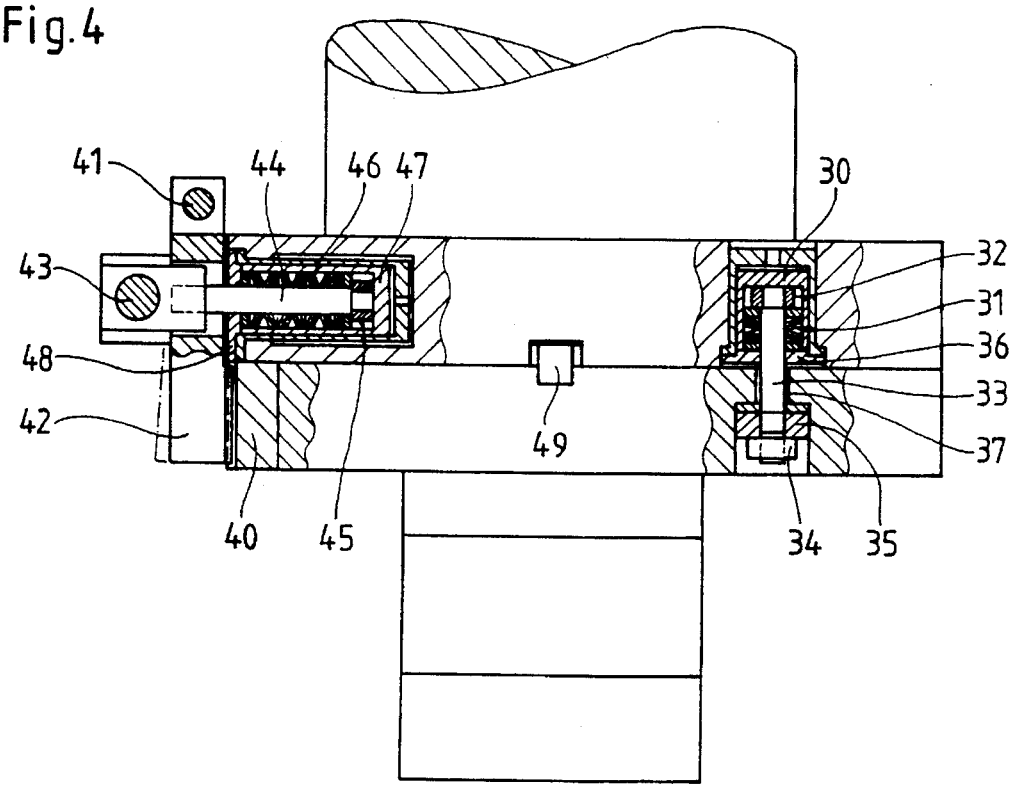
FIG. 4 is a lateral view, partly in section, of the detail illustrated in FIG. 3.
Figure 5:
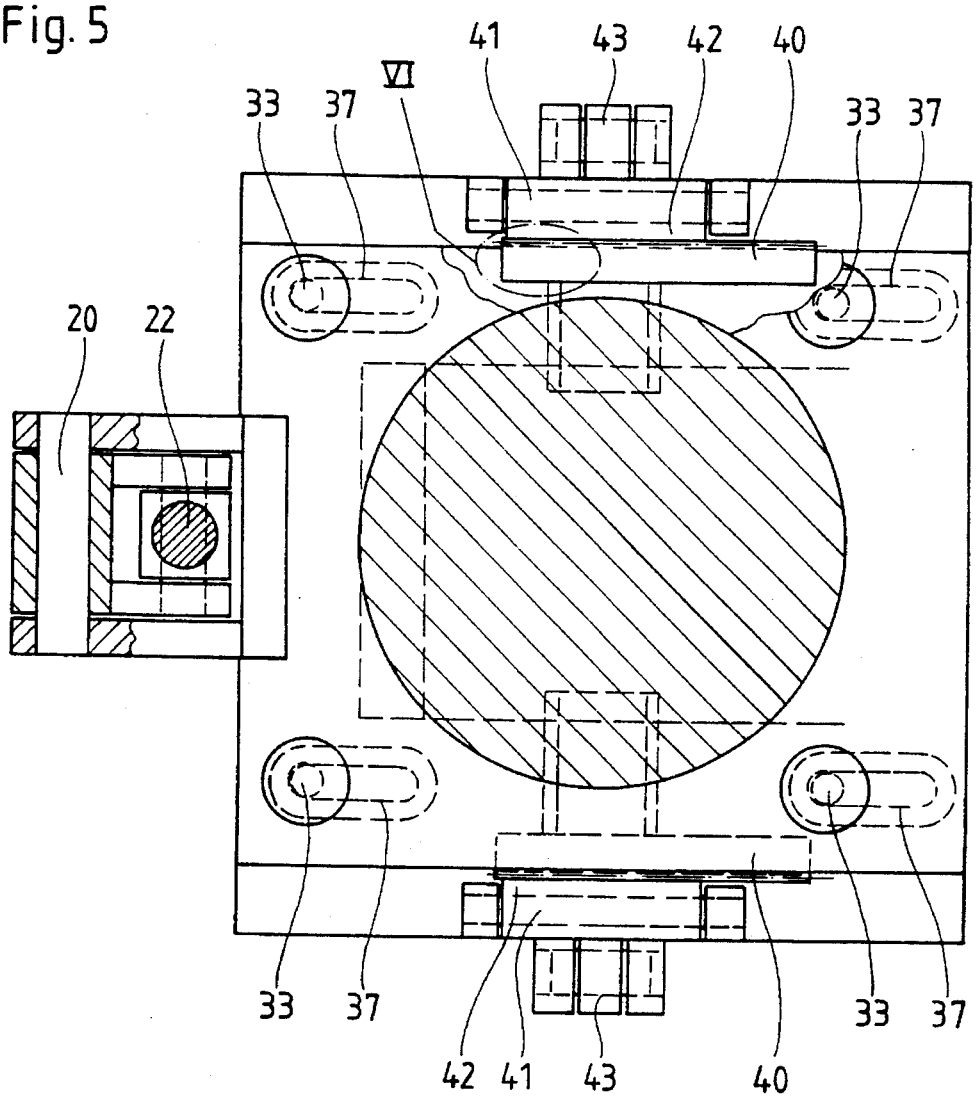
FIG. 5 is a plan view of the detail illustrated in FIG. 3.

The forging machine comprises a frame 1 which guides four rams 2 in a common plane at right angles to the system axis S, the rams 2 being offset at 90° to one another in a cruciform manner and being movable radially to the system axis S. The rams 2 are equipped with tools at their ends facing the system axis S. At their ends remote from the system axis S the rams 2 are in the form of cylinders 4 open towards the outside, i.e. they are provided with cylinder bores **4*b*. The parts of the rams which form the cylinders 4 may be separate parts connected to the rams 2** in a releasable manner.

Plunger pistons 5 with stuffing boxes 6 and seals 7 are inserted in the cylinders 4. The pistons 5 are supported on crossheads 8 which are connected by tie rods 9 to the frame with the interposition of support blocks 11 and pressure columns 10 with pre-stressing. Pressure medium can be supplied or removed by way of the bores 12 in the crossheads 8 and by way of bores 13 in the pistons 5. The cylinders 4 are provided with flanges 14 which are each provided with two projections **14*a*. The rams 2 with the tools 3 are caused to return by piston-cylinder units, the cylinders 15 of which are supported on the frame 1, and the pistons 16, act upon the projections 14*a* and thus upon the cylinders 4 and the rams 2**.

The tools 3 should form virtually closed pass contours in the innermost end positions of the stroke of the rams 2. In order to be able to form closed pass contours of different cross-section without changing the tools, the tools 3 are secured to supports 17 and are displaceable therewith, in the operating plane of the tools 3, transversely to the rams 2 on front plates 18 of the rams 2, the displacement being performed to an extent which prevents a collision with the adjacent tool 3 in the inner end position of the stroke thereof. The transverse displacement of one tool 3 takes place as a function of the setting of the end position of the stroke of the adjacent tool 3, which with its unused operating width covers the facing lateral face of the said one tool 3. In order to displace the support 17 along the front plate 18 of the ram 2 a respective angle lever 19 is provided, which is mounted on the front plate 18 of the ram 2 so as to be rotatable about a pin 20 and is connected to the support 17 by way of a link bar 21. The lever 19 can be pivoted by a linear reciprocating drive 23 thorough a push-pull rod 22. The linear reciprocating drive 23 is connected to the ram 2 by way of the ram cylinder 4 and is supported on the flange 14. The support 17 is connected to the front plate 18 of the ram 2 by clamping and locking devices (shown in greater detail in FIGS. 3 to 6) which are released to allow the transverse displacement of the support 17 with the tool 3. The linear reciprocating drive 23 is formed by two piston-cylinder units 24*a* and 24*b* connected together end to end, the piston rod of the outer piston-cylinder unit 24*a* being connected to the flange 14 by way of a bearing bracket 25, while the piston rod of the inner piston-cylinder unit 24*b* is joined as an extension to the push-pull rod 22. Activation of one or both of the piston-cylinder units 24*a* or 24*b* results in the movement of the rod 22 through the stroke of one or both pistons, and the support 17 together with the tool 3 is accordingly pushed into a first or second position of the tool 3 indicated with broken lines. The ram 2 can be moved into three defined stroke-end positions in accordance with the three settings of the tool 3. To this end, a stop block 26 is secured to the frame 1 in the path of the flange projections 14*b* of the ram cylinder 4 on both sides of the ram 2. The said stop blocks 26 fix the inner end position of the stroke of the ram 2 and thus the tool 3, in which end position they are at the smallest distance from the system axis S. Other end positions of the stroke of the ram 2 with the tool 3 are set by spacer plates 27 and 28, which can be pivoted by piston-cylinder units 29 about the columns 10 into positions above the stop blocks 26 in the path of the projections 14*b*, as set forth in more detail in copending applications Ser. Nos. 08/357,318 entitled "Forging Machine" of even date with the present application, the contents of which are incorporated herein by reference.

As is shown in detail in FIGS. 3 to 6, four clamping units are provided for clamping the support 17 to the front plate 18 of the ram 2. Each said clamping unit (FIG. 4) comprises a cylinder 30 with a piston 32 guided in the said cylinder 30 and movable against the force of a return spring 31 by a pressure medium supplied to the cylinder. A pressure plate 35 is connected to the piston rod 33 by a nut 34. The cylinder 30 is inserted rigidly in the ram front plate 18 and is provided with a cover 36 which acts as a support for the spring 31. The piston rod 33 passes through a hole 37 in the support 17, elongated in the direction of movement of the support 17. The said elongate hole 37 is enlarged in cross section to form a T-section groove, on the shoulders of which the pressure plate 35 rests.

The support 17 is provided with toothed racks 40 on the two sides that are parallel to the operating plane. Locking members 42, which have teeth corresponding to the teeth of the toothed racks 40, are mounted on the front plate 18 so as to be pivotable about shafts 41 mounted on the front plate 18 parallel to and to one side of the racks. The locking members 42 are connected by way of shafts 43 to transverse piston rods 44, the pistons 45 of which are acted upon by springs 46 in such a direction that the locking members 42 are engaged with the racks 40. The pistons 45 in cylinders 47 can be actuated by pressure medium against the force of the springs 46, as a result of which the locking members 42 are pivoted about shafts 41 and disengaged from the racks. The cylinders 47 are secured in the front plate 18 and are provided with covers 48 supporting the springs 46.

After the fastening of the support 17 to the front plate 18 has been released by actuation of the pistons 32, and the locking between the toothed racks 40 and the locking members 42 has been disengaged by actuation of pistons 45, the support 17 can be displaced with respect to the front plate 18 by the linear reciprocating drive 23 through the rod 22, the angle lever 19 and the link bar 21. A strip 49, which engages in grooves in the front plate 18 and the support 17, is used for guiding the support 17 on the front plate 18. After the displacement of the tool support has taken place, the pistons 32 and 45 are relieved of pressure, so that the support 17 is clamped against and locked to the front plate 18 under the action of the springs 31 and 46.

It will be seen that, in the present construction, the locking and unlocking of the tool support on the ram does not involve any need to move the tool support away from the ram front plate. The locking teeth can be engaged and disengaged while the tool support and front plate remain in contact. The movement of the clamping units need be no more than just enough to release the clamping pressure and friction between the tool support and the ram front plate.

Consequently it is never necessary to open up any significant gap between the tool support and front plate, no significant suction arises which might cause dirt to be drawn in between the tool support and front plate, and furthermore, the gap between these remains small so that penetration of dirt is substantially eliminated.

Figure 6:
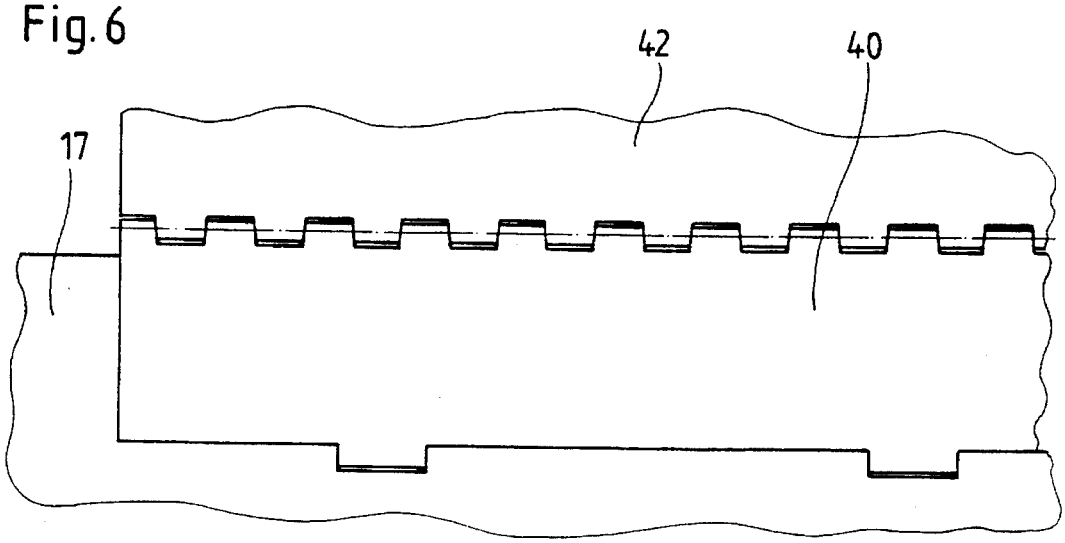
FIG. 6 shows the detail indicated by the circle VI in FIG. 5 further enlarged.

The teeth, show in FIG. 6, of the toothed rack 40 with the locking members 42 are dimensioned as an integral fraction of the displacement of the support 17 produced by one of the piston-cylinder units 23 with respect to the front plate 18.

I claim:

1. A forging machine comprising a frame defining an axis along which a workpiece can be passed longitudinally, a plurality of forging rams supported by the frame and arranged at angles to one another in an operating plane perpendicular to the workpiece longitudinal axis, for radial ram movement relative to a workpiece, hydraulic drive means for effecting such radial ram movement for forging said workpiece, respective forging tool supports carried by the rams, forging tools carried by said supports, said tools having respective working surfaces and having a closest inner position in which their working surfaces together form a forging pass bounded by operative portions of the widths of the respective tools, dependent on the size of the pass, each tool in said position having a side surface which overlaps an unused inoperative portion of the width of the working surface of one of the adjacent tools, and having itself an unused inoperative portion of the width of its working surface overlapped by said side surface of the other one of the adjacent tools, respective setting devices for adjusting the position of each tool support in the operating plane transversely off-centre relative to the direction of said radial movement, whereby the widths of said operative portions of the tool working surfaces can be adjusted to provide a forging pass of selected size, releasable clamping means for clamping said tool support to said rams, and releasable locking means operative between said tool supports and rams for locking said tool supports selectively in positions thereby adjusted by said setting devices, said locking means being disposed at peripheral sides of said supports extending parallel to the plane in which said supports are displaceable, and comprising locking members provided on said rams adjacent said tool supports, a plurality of teeth each transverse to the support displacement direction being provided on one of said supports and said locking members, and at least one cooperating locking element on the other of said supports and locking members, and means for effecting relative movement to engage and disengage said teeth and at least one cooperating locking element for effecting and releasing positive locking of the tool support plate on the ram in the direction of displacement thereof.

2. The forging machine of claim 1, wherein said teeth are provided on said side of said tool support, and said locking member is movably mounted on said ram.

3. The forging machine of claim 1, wherein said locking member is provided with a plurality of teeth corresponding to the first mentioned said teeth.

4. A forging machine with four rams which are arranged in a cruciform manner in one plane, are offset at 90° to one another, act radially upon the workpiece guided longitudinally in the system axis and are equipped with tools, wherein the tools are displaceable in their common plane by means of tool supports by displacement devices, acting upon the supports, transversely to the rams and the supports being settable with respect to the rams by engageable and disengageable positive locking means and releasable clamping devices, the supports being provided on their peripheral sides parallel to the displacement plane with teeth transverse to the displacement direction, into and out of which teeth locking members, locked on the rams in the displacement direction, can be engaged and disengaged.

5. A forging machine comprising a frame defining an axis along which a workpiece can be passed longitudinally, a plurality of forging rams supported by the frame and arranged at angles to one another in an operating plane perpendicular to the workpiece longitudinal axis, for radial ram movement relative to a workpiece, hydraulic drive means for effecting such radial ram movement for forging said workpiece, respective forging tool supports carried by the rams, forging tools carried by said supports, said tools having respective working surfaces and having a closest inner position in which their working surfaces together form a forging pass bounded by operative portions of the widths of the respective tools, dependent on the size of the pass, each tool in said position having a side surface which overlaps an unused inoperative portion of the width of the working surface of one of the adjacent tools, and having itself an unused in operative portion of the width of its working surface overlapped by said side surface of the other one of the adjacent tools, respective setting devices for adjusting the position of each tool support in the operating plane transversely off-center relative to the direction of said radial movement, whereby the widths of said operative portions of the tool working surfaces can be adjusted to provide a forging pass of selected size, releasable clamping means for clamping said tool support to said rams, and releasable locking means operative between said tool supports and rams for locking said tool supports selectively in positions thereby adjusted by said setting devices, said locking means being disposed at peripheral sides of said supports extending parallel to the plane in which said supports are displaceable, and comprising locking members provided on said rams adjacent said tool supports, a plurality of teeth each transverse to the support displacement direction being provided on one of said supports and said locking members, and at least one cooperating locking element on the other of said supports and locking members, and means for effecting relative movement to engage and disengage said teeth and at least one cooperating locking element for effecting and releasing positive locking of the tool support plate on the ram in the direction of displacement thereof, the locking members being secured to the ram so as to be pivotable about shafts parallel to the displacement direction and being provided at their free ends, facing the supports, with teeth corresponding to the teeth on the supports.

6. A forging machine comprising a frame defining an axis along which a workpiece can be passed longitudinally, a plurality of forging rams supported by the frame and arranged at angles to one another in an operating plane perpendicular to the workpiece longitudinal axis, for radial ram movement relative to a workpiece, hydraulic drive means for effecting such radial ram movement for forging said workpiece, respective forging tool supports carried by the rams, forging tools carried by said supports, said tools having respective working surfaces and having a closest inner position in which their working surfaces together form a forging pass bounded by operative portions of the widths of the respective tools, dependent on the size of the pass, each tool in said position having a side surface which overlaps an unused inoperative portion of the width of the working surface of one of the adjacent tools, and having itself an unused in operative portion of the width of its working surface overlapped by said side surface of the other one of the adjacent tools, respective setting devices for adjusting the position of each tool support in the operating plane transversely off-center relative to the direction of said radial movement, whereby the widths of said operative portions of the tool working surfaces can be adjusted to provide a forging pass of selected size, releasable clamping means for clamping said tool support to said rams, and releasable locking means operative between said tool supports and rams for locking said tool supports selectively in positions thereby adjusted by said setting devices, said locking means being disposed at peripheral sides of said supports extending parallel to the plane in which said supports are displaceable, and comprising locking members provided on said rams adjacent said tool supports, a plurality of teeth each transverse to the support displacement direction being provided on one of said supports and said locking members, and at least one cooperating locking element on the other of said supports and locking members, and means for effecting relative movement to engage and disengage said teeth and at least one cooperating locking element for effecting and releasing positive locking of the tool support plate on the ram in the direction of displacement thereof, springs arranged to engage the locking members, and counter-acting piston-cylinder units provided for disengaging the locking members.

* * * * *